United States Patent [19]

Hitt

[11] Patent Number: 4,506,174

[45] Date of Patent: Mar. 19, 1985

[54] SQUARE ROOT CIRCUIT WITH STABLE LINEAR CUT-OFF

[75] Inventor: James J. Hitt, Willow Grove, Pa.

[73] Assignee: General Signal Corporation, Stamford, Conn.

[21] Appl. No.: 441,004

[22] Filed: Nov. 12, 1982

[51] Int. Cl.[3] ..... G06G 7/12; G06G 7/20

[52] U.S. Cl. ..... 307/490; 307/491; 307/501; 328/144

[58] Field of Search ..... 328/142, 144, 145; 307/490, 571, 492, 574, 498, 501

[56] References Cited

U.S. PATENT DOCUMENTS

| | | | |
|---|---|---|---|
| 3,633,044 | 1/1972 | Buckstad | 328/142 |
| 3,663,833 | 5/1972 | Pao et al. | 328/144 |
| 3,942,036 | 3/1976 | Burckhardt et al. | 328/142 |
| 4,198,675 | 4/1980 | Moore | 328/144 |

*Primary Examiner*—Stanley, D. Miller
*Assistant Examiner*—B. P. Davis
*Attorney, Agent, or Firm*—W. G. Miller, Jr.; Harold Huberfeld

[57] ABSTRACT

A square root circuit is provided with a high gain amplifier for receiving the input and a squaring circuit in the negative feedback circuit of the amplifier to produce the desired square root output. A second negative feedback path is provided with a feedback resistor and switching means for selectively completing the connection of the second feedback path when the amplifier input falls below a certain predetermined level so that the amplifier provides a linear response in the low input region. This linear response will make the accurate setting of the zero possible without any manual switching in the amplifier feedback.

5 Claims, 4 Drawing Figures

FIG. 1
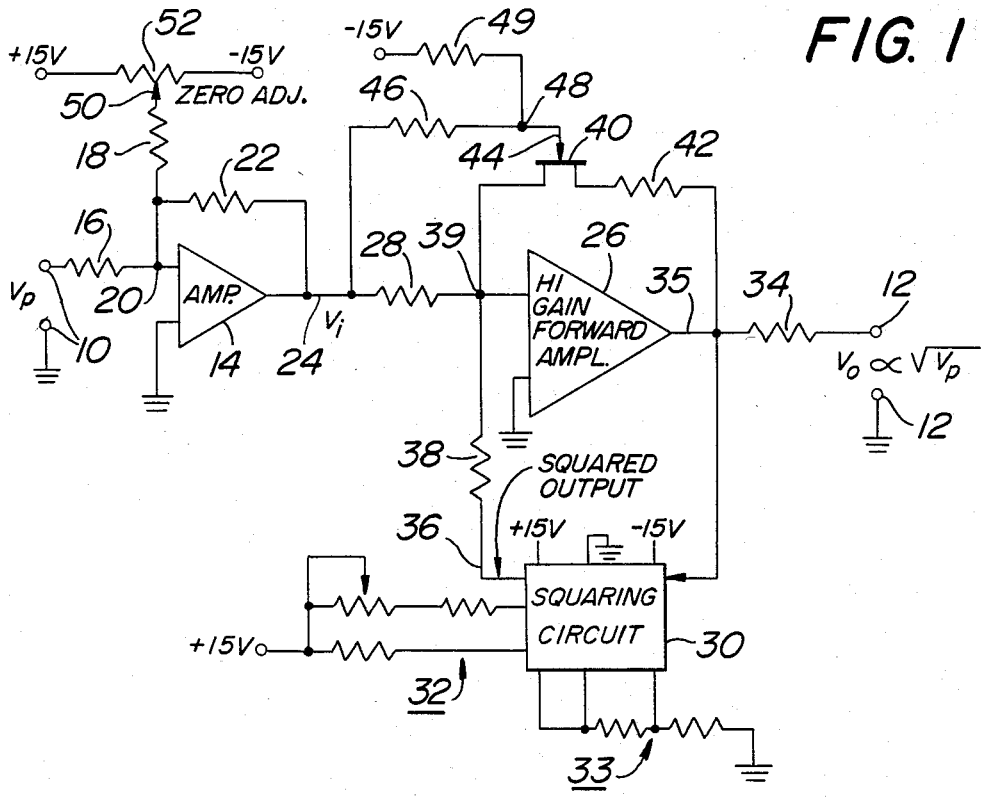
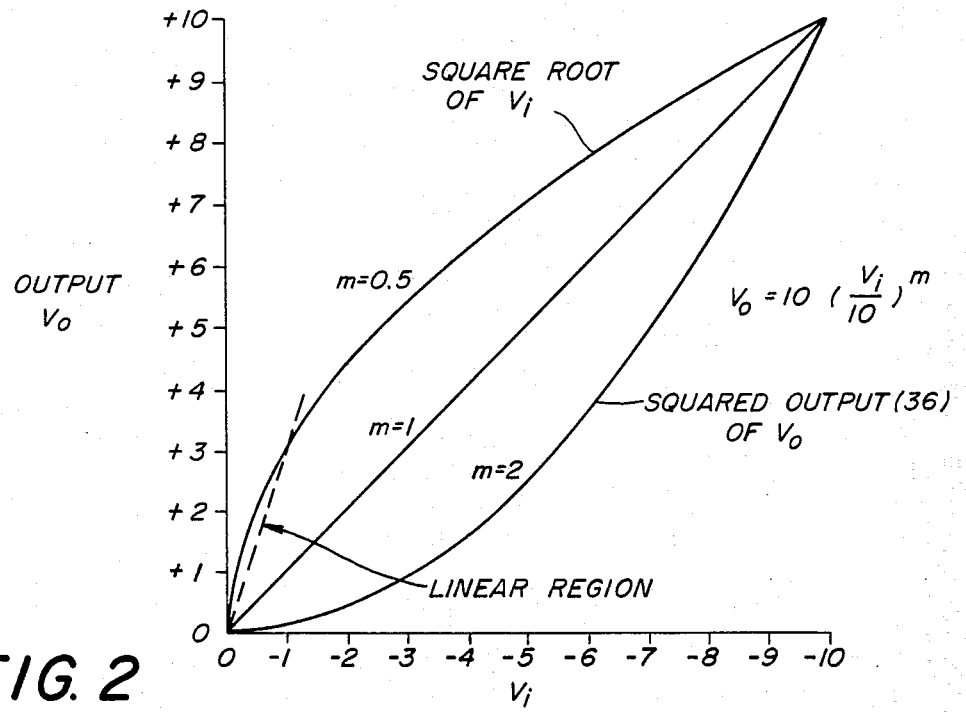
FIG. 2

FIG. 3
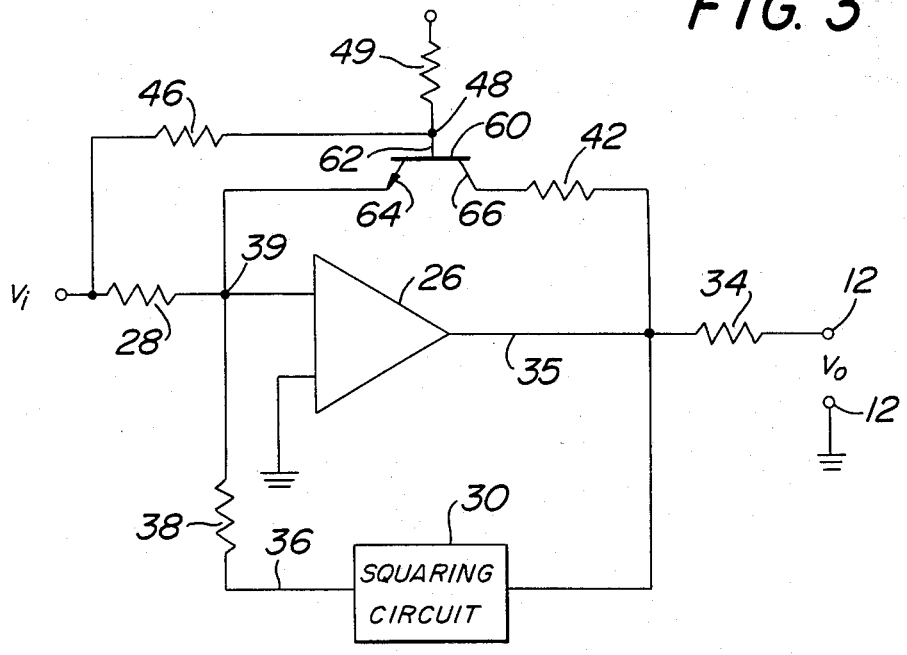
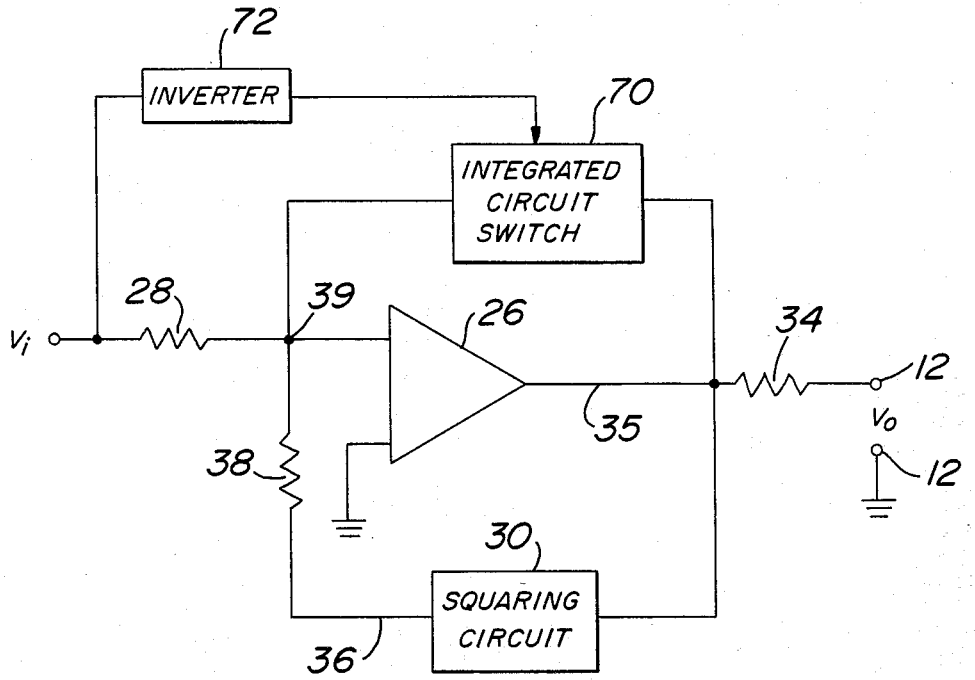
FIG. 4

SQUARE ROOT CIRCUIT WITH STABLE LINEAR CUT-OFF

BACKGROUND OF THE INVENTION

This invention relates to square root circuits such as those used with differential pressure transducers in the measurement of flow. The purpose of such a circuit is to provide a reading on a measuring instrument which is directly related to flow when the measurement is derived from a differential pressure transducer.

In the prior art analog circuits for this purpose have been constructed using high gain amplifiers with a squaring circuit inserted in the negative feedback path so that the output produced is proportional to the square root of the amplifier input. With such a circuit the adjustment of the zero has been accomplished by disconnecting the squaring circuit and then varying a signal added to the input so that with zero flow the reading obtained is zero.

The disconnection of the squaring circuit in the feedback has been necessary because of a problem which arises when the amplifier output is small. With such an output, the negative feedback signal developed by the squaring circuit has a very flat characteristic. Thus, with changes in input in the zero output region, there is very little change in output of the squaring circuit and a great change in output from the amplifier. Zeroing is therefore virtually impossible with the squaring circuit connected and in control of the feedback. Therefore manual switching to remove the squaring circuit is resorted to with the inevitable problems of manual operation, such as the operator forgetting to reconnect the squaring circuit.

In addition to the zeroing problem, it is difficult at low flows for the operator to determine if the circuit is operable, for he might not observe changes in the readings of the magnitude he would normally expect. Although accurate readings in the low flow range may not be important, such unexpected changes lead to a lack of confidence in the measuring system.

It is an object of this invention to provide a square root circuit which will make it possible to accurately zero the measurement being made by the circuit and provide a smooth change in output as input approaches zero.

SUMMARY OF THE INVENTION

A square root circuit is provided with a high gain amplifier for receiving the input and a squaring circuit in the negative feedback circuit of the amplifier to produce the desired square root output. A second negative feedback path is provided with a feedback resistor and switching means for selectively completing the connection of the second feedback path when the amplifier input falls below a certain predetermined level so that the amplifier provides a linear response in the low input region. This linear response will make the accurate setting of the zero possible without any manual switching in the amplifier feedback.

BRIEF DESCRIPTION OF THE DRAWINGS

In the drawings:

FIG. 1 is a circuit diagram of one form of the invention.

FIG. 2 is a graphical plot of input vs. output.

FIG. 3 is a circuit diagram of another form.

FIG. 4 is still another form which the invention can take.

DESCRIPTION OF THE PREFERRED EMBODIMENT

In FIG. 1 there is shown a circuit for receiving at terminals 10 the output of a differential pressure transducer $V_p$ and producing at output terminals 12 an output $V_o$ proportional to the square root of $V_p$.

The voltage $V_p$ is introduced as an input to a preamplifying stage provided by an operational amplifier which includes the amplifier 14, a first input resistor 16 and a second input resistor 18 which connect the two inputs to the summing junction 20 at the inverting input of amplifier 14. Also connected to the summing junction is the negative feedback circuit which includes resistor 22 connecting the summing junction with the output of amplifier 14.

The output of amplifier 14 on line 24 provides the input $V_i$ to the square root circuit. This circuit is shown in FIG. 1 as an operational amplifier which utilizes a high gain forward amplifier 26 which amplifies the input received from line 24 through input resistor 28 to produce through output resistor 34 the output $V_o$ at terminal 12.

Two negative feedback circuits are provided. The first feedback circuit utilizes a squaring circuit 30 with its necessary ancillary networks 32 and 33 to produce on line 36 from the amplifier output signal on line 35 a squared output which is introduced through a feedback resistor 38 to the inverting input of amplifier 26 at summing junction 39.

Means are provided in a second negative feedback circuit for providing a linear circuit in the low input region. Thus, the output on line 35 is introduced on one of the channel (drain) terminals of an N channel FET 40 through the feedback resistor 42. The other source terminal of the FET 40 is connected to summing junction 39 so that when the gate 44 of FET 40 is at a low negative value or is positive, the connection of the feedback through FET 40 is made (the FET is conductive).

A bias circuit which will operate the FET 40 in the desired way is provided by bias resistor 46 which connects the input on line 24 to the resistor bias point 48 and gate 44. The bias circuit also includes resistor 49 which connects a $-15$ volt supply to bias point 48. The bias on FET 40 is thus modified with changes in the input on line 24.

The FET 40 may be an N channel JFET or a MOSFET but it must be, in general, a depletion type so that for small negative input voltages on line 24 the FET is on.

In operation of the circuit of FIG. 1, when there is zero flow being detected by the differential pressure transducer which would be connected to provide the input $V_p$, it is desirable to provide a zero output for $V_o$ or whatever output voltage is required to produce a zero reading on the measuring instrument connected to terminals 12. This zero adjustment is obtained by adjusting the tap 50 on potentiometer 52 which is connected between a positive and a negative voltage supply such as $+15$ volts and $-15$ volts, as shown in FIG. 1. Thus, tap 50 provides a bias to input resistor 18 as required to zero the indication produced by input $V_p$.

In FIG. 2 there is plotted the curves relating $V_i$ and $V_o$ in the equation $$V_o = 10\left(\frac{V_i}{10}\right)^m$$

for three values of m. The solid lines show the relationships which exist when the FET 40 is not conducting. From these graphical representations it is evident that for variation of $V_i$ in the region close to zero the squared output changes very little and the square root output changes too rapidly to make accurate zeroing possible.

When the input voltage $V_i$ is more negative than 1 volt, the FET 40 becomes non-conductive by virtue of the reduced bias on its gate. With FET 40 conductive, the second feedback circuit R42 and FET 40 predominates and the characteristic becomes linear as shown by the dashed line in FIG. 2. Thus, when $V_i$ is less negative than 1 volt, the circuit is linear and a zero can be accurately determined.

The circuit of FIG. 1 is thus not calibrated for measuring flows in the region near zero due to the linear characteristic in that region; however, this is usually no handicap since that extreme region in the range is seldom of interest for accurate flow measurement.

In the circuit of FIG. 1 with a range of $V_i$ from 0 to −10 volts, and with a range of $V_o$ from 0 to +10 volts, the various components of the circuit may have the values set forth below:

| Resistor | Value |
|---|---|
| 28 | 20K |
| 38 | 20K |
| 46 | 150K |
| 49 | 10M |
| 42 | 10K |
| Unit 30 | Burr Brown 4302 |

In FIG. 3, where elements like those of FIG. 1 are identified by like numbers, the FET of FIG. 1 is replaced by an NPN transistor 60 which is connected to act as a switch. The base 62 is connected to the bias point 48 with the emitter 64 connected to summing junction 39 and the collector 66 connected to the output 35 through feedback resistor 42. With the arrangement of FIG. 3 the transistor will switch in the feedback path including resistor 42 so that the output at terminals 12 will be linear in the region where the input $V_i$ is low.

In FIG. 4 the squaring feedback is shorted out by an integrated circuit switch 70, such as a DG 200, which is operated through inverter 72 from the input $V_i$ so that the switch 70 completes the shorting operation when the input is low.

What is claimed is:

1. In a square root insertion circuit having a high gain amplifier for receiving an input signal and a squaring circuit in a negative feedback path for said amplifier to produce in the amplifier output a signal which is continuously the square root of said input signal and thus produces a large change in said amplifier output signal for small changes in said input signal in the region where said output signal is near zero, the improvement comprising:

another negative feedback path having a feedback resistor and switching means for selectively completing the connection of said another feedback path when said input falls below a certain level so that said circuit has a more linear characteristic when said input is below said certain level.

2. The circuit of claim 1 in which said switching means is a depletion type FET.

3. The circuit of claim 1 in which the other negative feedback path includes a feedback resistor and said switching element is a depletion type JFET.

4. The circuit of claim 1 in which the other negative feedback path includes a feedback resistor and the switching means is a depletion type MOSFET which is connected in series with said feedback resistor.

5. The circuit of claim 1 in which the switching means is a depletion type FET with said certain level at which the other feedback circuit is completed established by a biasing circuit connected to receive said input signal, said biasing circuit resistor connecting the input to the gate of said FET and adjustable bias means connected to said gate to provide adjustment for said bias.

* * * * *